US005186363A

United States Patent [19]

Haynes

[11] Patent Number: 5,186,363

[45] Date of Patent: Feb. 16, 1993

[54] LIQUID MIXING AND DISPENSING NOZZLE

[76] Inventor: Joel E. Haynes, 6248 Wynne Ave., Reseda, Calif. 91335

[21] Appl. No.: 838,833

[22] Filed: Feb. 21, 1992

[51] Int. Cl.[5] ..... B67D 5/60

[52] U.S. Cl. ..... 222/145; 222/129.1; 239/110; 239/424

[58] Field of Search ..... 222/129.1, 129.2, 129.3, 222/129.4, 145; 239/110, 424

[56] References Cited

U.S. PATENT DOCUMENTS

| | | | |
|---|---|---|---|
| 3,800,826 | 4/1974 | McCann | 222/129.1 X |
| 4,753,370 | 6/1988 | Rudick | 222/129.1 X |
| 4,808,346 | 2/1989 | Strenger | 222/129.1 X |
| 4,863,068 | 9/1989 | Smith | 222/129.1 |
| 4,986,447 | 1/1991 | McCann et al. | 222/145 X |

FOREIGN PATENT DOCUMENTS

| | | | |
|---|---|---|---|
| 899840 | 6/1962 | United Kingdom | 222/145 |

*Primary Examiner*—Andres Kashnikow
*Assistant Examiner*—Joseph A. Kaufman
*Attorney, Agent, or Firm*—Jack C. Munro

[57] ABSTRACT

A liquid mixing and dispensing nozzle for a beverage which is to combine a concentrate (syrup) with a non-viscous liquid in a manner to increase the amount of carbonation leaving the soda yet achieving even mixing of the soda and the syrup. These advantages are obtained at a high flow rate, such as approximately six ounces per second of the beverage. The nozzle discharges the soda in an annular pattern with the syrup being discharged centrally within this pattern.

12 Claims, 2 Drawing Sheets

FIG. 6
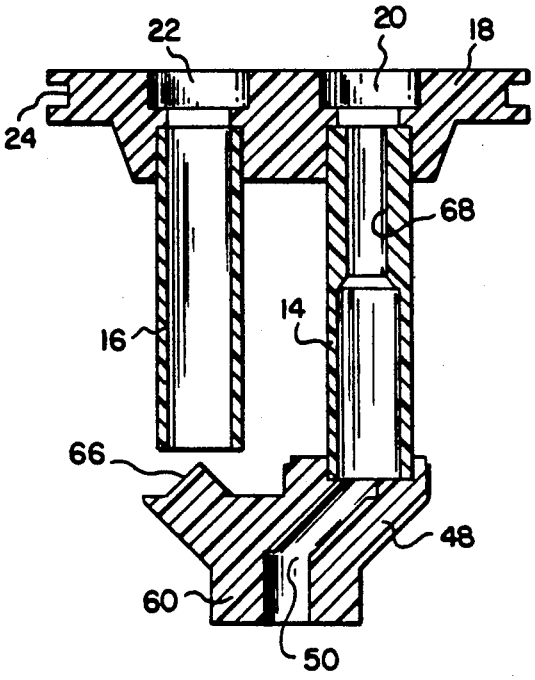
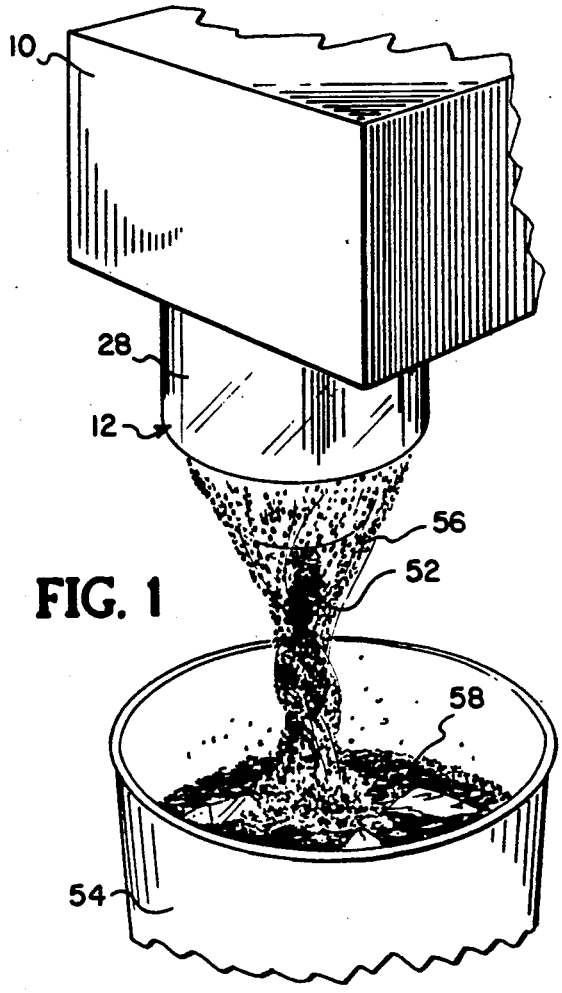
FIG. 1
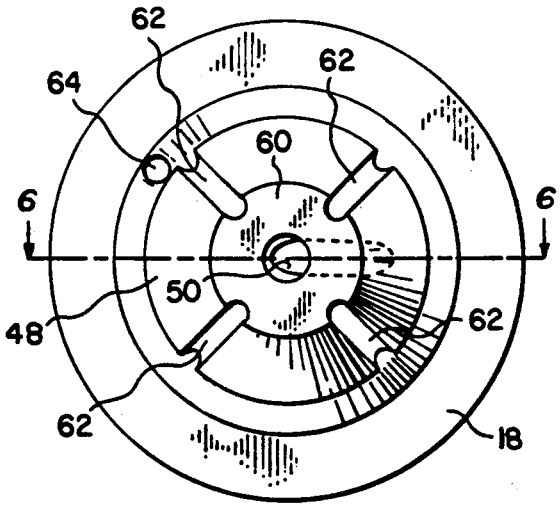
FIG. 5
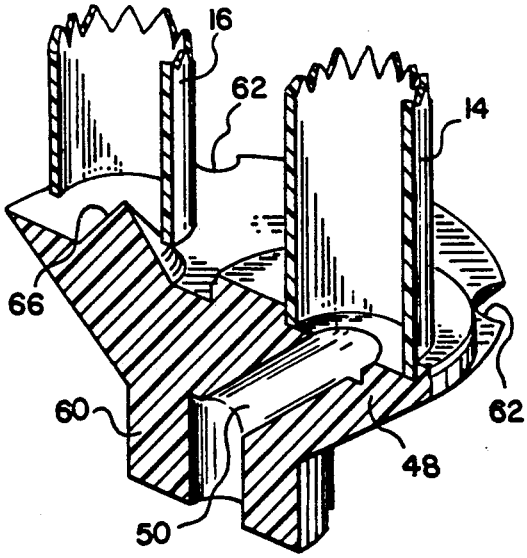
FIG. 7

LIQUID MIXING AND DISPENSING NOZZLE

BACKGROUND OF THE INVENTION

1) FIELD OF THE INVENTION

The subject matter of the present invention relates to a liquid mixing and dispensing nozzle to be used in conjunction with a post-mix beverage dispenser.

2) DESCRIPTION OF PRIOR ART

Post-mix beverage dispensers control the flow and mixing of two or more liquids. Generally, one liquid is non-viscous such as water which is saturated with carbon dioxide ($CO_2$) and the other liquid is a concentrate, such as a flavored syrup. The dispenser delivers the liquids into a container with the liquids mixing to comprise the beverage that is to be obtained. Ideally, the dispensing of the liquids is to be accomplished rapidly, at the proper mixture ratio, at the proper temperature, create a minimum amount of foam with good $CO_2$ retention and is thoroughly mixed (no stratification).

The primary use of such nozzles has been in the fast food environment. The clerk that is dispensing of the beverage places a cup or glass in association with the beverage dispenser at which time the beverage dispenser is activated thereby discharging the separate liquids into the cup or glass thereby producing the resulting beverage. It is important for the clerk to achieve the dispensed beverage as quickly as possible, thereby permitting the clerk to serve as many people in the shortest amount of time. It used to be that these liquids were dispensed at three ounces per second. However, in recent years, the dispensing rate has doubled to six ounces per second. Although the speed of the dispensed beverages is increased, it has been found that the carbon dioxide ($CO_2$) within the soda is encouraged to escape from the soda which causes a substantial amount of foam. The clerk must then wait until the foam settles and then reactivates the beverage dispensing system to achieve the desired amount of the dispensed beverage for the consumer. This waiting for the foam to settle substantially increases the time of dispensing which when compounded with the large number of consumers that are served each and every day within a normal fast food outlet, results in a most inefficient dispensing operation.

Stratification within the dispensed beverage occurs by poor mixing of the soda water and the syrup. Stratification also occurs if the soda and the syrup do not arrive simultaneously at the mixing point at the beginning of a dispensing cycle. Within prior art nozzles, the syrup is usually introduced into the soda at the exit of the nozzle with the syrup being introduced into the soda through a plurality of small passages. This prior art configuration causes the syrup to begin to dispense before the soda water which causes stratification. The force of the flow of the syrup, due to the difference in direction and velocity from that of the soda, can also cause $CO_2$ loss and increased foam. Increased foam is the result of $CO_2$ coming out of solution after the soda water is mixed with the syrup.

Also, prior art dispensing valves have been known to use flow regulators upstream of the control valves that are utilized to regulate the dispensing of the syrup and the soda water. These flow regulating devices are known to cause severe turbulence within the mixture which produces increased foam and pressure loss. This turbulence, along with the large pressure change, causes a substantial amount of the $CO_2$ leaving the soda water.

SUMMARY OF THE INVENTION

The primary objective of the present invention is to construct a liquid mixing and dispensing nozzle for a beverage dispenser which dispenses the beverage at a high rate, minimizes the amount of $CO_2$ coming out of solution, thereby decreasing the amount of foam that is created and yet achieves substantially even mixing of soda water and syrup, thereby decreasing stratification.

The liquid mixing and dispensing nozzle of the present invention includes a syrup supply tube and a soda supply tube. Both supply tubes are mounted within an accumulator chamber which is formed within a accumulator wall which is substantially cylindrical. However, the bottom surface of the accumulator wall narrows down to a lesser diameter than the top surface. The syrup supply tube mounts onto a diffuser housing which is also located within an accumulator chamber. Included within the diffuser housing is a syrup conducting passage that connects directly to the exterior of the accumulator wall aligned with the longitudinal center axis of the accumulator chamber. This longitudinal center axis is to be aligned with the force of gravity. The soda supply tube discharges soda directly adjacent to the bottom of the accumulator chamber and this chamber is filled and overflows through a plurality of holes located directly adjacent the top of the chamber. This overflowing soda flows by capillary action along the exterior surface of the accumulator wall to the bottom. From the bottom, the soda is permitted to fall free in a tubular or annular arrangement into a collecting container such as a cup or glass. The syrup is being simultaneously dispensed through the syrup conducting passage into the container with this syrup being dispensed in correct proportion to the soda with the dispensing occurring centrally within the annular dispensing pattern of the soda. The syrup could be dispensed through a tube located within the larger diametered soda tube with equal results should packaging considerations dictate. Leakage ports are provided to drain the accumulator chamber when soda is no longer being supplied within the accumulator chamber. The diffuser housing includes a diffusing cone and it is onto this diffusing cone that the soda is discharged. The purpose of the diffusing cone is to evenly distribute the soda within the accumulator chamber.

BRIEF DESCRIPTION OF THE DRAWINGS

FIG. 1 shows the liquid mixing and dispensing nozzle of the present invention depicting usage in dispensing of two liquids within a container;

FIG. 5 is a bottom plan view of the diffuser housing utilized within the liquid mixing and dispensing nozzle of the present invention;

FIG. 6 is a cross-sectional view showing in more detail the liquid supply tubes and the diffuser housing taken along line 6—6 in FIG. 5; and FIG. 7 is a cross-sectional and partially cut away view through the diffuser housing utilized in conjunction with the nozzle of the present invention.

DETAILED DESCRIPTION OF THE SHOWN EMBODIMENT

Figure 2:
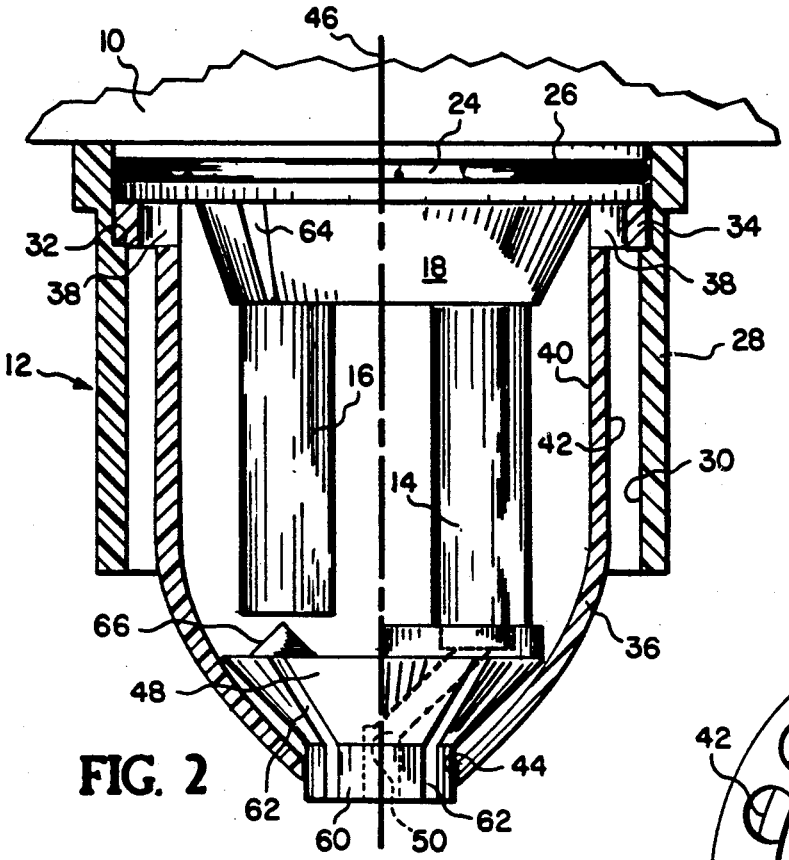
FIG. 2 is a longitudinal cross-sectional view through the liquid mixing and dispensing nozzle of the present invention.
Figure 4:
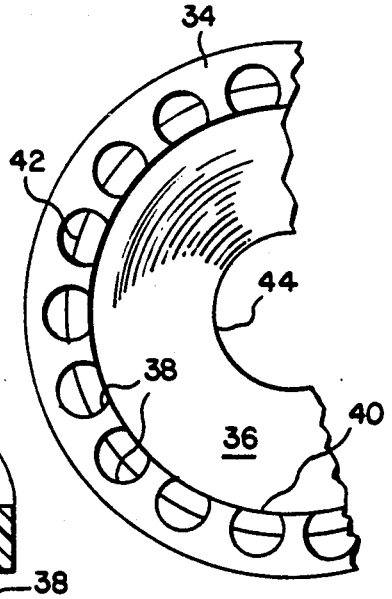
FIG. 4 is the top plan view of the accumulator wall utilized in conjunction with the nozzle of the present invention.
Figure 3:
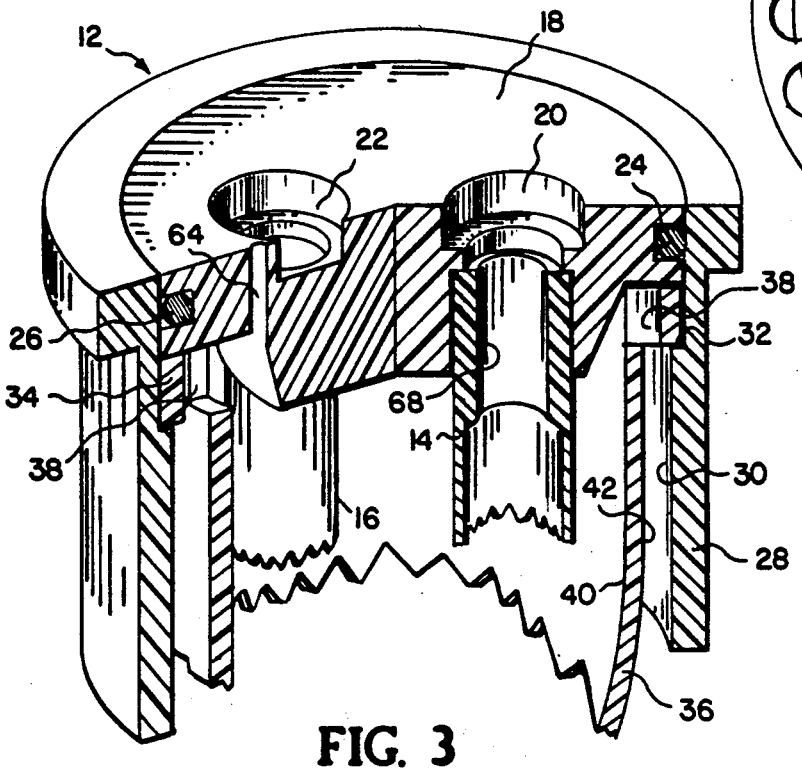
FIG. 3 is an isometric view, partially cut away and in cross section, through the liquid mixing and dispensing nozzle of the present invention.

Referring particularly to the drawing, there is shown a dispensing valve housing 10 to which the nozzle 12 of this invention is attached. The construction of the dispensing valve housing 10 does not specifically form part of this invention and therefore will no be described in detail within the present application. However, the dispensing valve housing 10 is to cause a concentrate liquid, such as a syrup, to be discharged into a supply tube 14 and a carbonated non-viscous liquid, such as a soda water, to be discharged within a supply tube 16. The supply tubes 14 and 16 are located basically parallel. The supply tubes 14 and 16 are both mounted on a disc 18. Disc 18 has a pair of spaced apart ports 20 and 22. Port 20 connects to supply tube 14 and port 22 connects to supply tube 16.

Formed within the periphery of the disc 18 is an annular groove 24. Within the annular groove 24 is located an o-ring seal 26. The o-ring seal 26 is to form a liquid tight engagement with a confining sleeve 28. Confining sleeve 28 is cylindrical and defines a cylindrical internal chamber 30. The wall of this chamber 30 includes an annular ledge 32. Supported between, in a tight-fitting manner, the disc 18 and the ledge 32 is a ring 34. The ring 34 is mounted on and is integral with an accumulator wall 36. Accumulator wall 36 is of a lesser diameter than ring 34. Formed within the ring 34 are a plurality of evenly spaced apart holes 38. It is to be noted that there are eighteen in number of the holes 38. However, this number could be decreased or increased without departing from the scope of this invention. The purpose of the holes 38 is to provide flow for a liquid between the accumulator chamber 40 formed internally of the accumulator wall 36 and the exterior surface 42 of the accumulator wall 36.

The ring 34 is located at the top of the accumulator wall 36. At the bottom of the accumulator wall 36 is a formed an opening 44. The center of opening 44 lies on longitudinal center axis 46 of the accumulator wall 36. It is to be noticed that the accumulator wall 36 tapers or narrows in the area of opening 44. This means that the bottom of the accumulator wall 36 is of a substantially smaller diameter than the top of the accumulator wall 36.

Fixedly mounted on the free lower end of the supply tube 14 is a diffuser housing 48. Diffuser housing 48 has a liquid conducting through passage 50. The outlet of this passage 50 is centrally aligned with the axis 46. The concentrate liquid in the form of syrup 52 is to be discharged through the supply tube 14, through passage 50 and then into the container 54. Combined with that syrup 52 is the carbonated soda water 56 which, when evenly mixed with the syrup 52, forms the beverage 58 within the container 54.

The diffuser housing 48 has a necked down section 60. This necked down section 60 is to snugly fit within the opening 44. Formed within the exterior wall surface of the diffuser housing 48 and the exterior wall surface of the necked down section 60 are a plurality of ports 62. It is to be noted that there are four in number of the ports 62 located in equiangularly spaced apart manner about the diffuser housing 48. However, the number and the size of the ports 62 could be varied without departing from the scope of this invention.

Disc 18 includes an air passage 64. This air passage 64 provides for conducting of air between the accumulator chamber 40 and the ambient. Mounted on the diffuser housing 60 is a diffusing cone 66. This diffusing cone 66 is aligned with the outlet of the supply tube 16.

The operation of the liquid mixing and dispensing nozzle 12 of this invention is as follows: The operator, which will generally be termed a clerk, is to place the container 54 underneath the nozzle 12. Prior to activation, no soda water 56 is located within the supply tube 16. However, it has generally been found that the syrup 52 will reach a level within smaller diametered section 68 of the supply tube 14. The syrup 52 will assume this level and be retained at this level strictly by capillary action within the smaller diametered section 68.

Upon the clerk activating the dispensing mechanism associated with or mounted within the dispensing valve housing 10, the syrup 52 will begin to flow through the supply tube 14 in the passage 50 and at a certain velocity exteriorly of the diffuser housing 60 into the container 54. At the same time, the soda water 56 is caused to flow through the supply tube 16 into contact with the diffuser cone 66 and be evenly dispersed throughout the accumulator chamber 40 and fill such. The soda water 56 then overflows the accumulator wall 36 and flows through holes 38 into the annular gap area formed between the wall of the internal chamber 30 and the exterior surface 42 of the accumulator wall 36. This soda water 56 flows by capillary action along the exterior surface 42 to the bottom adjacent opening 44. The confining sleeve 28 prevents any exterior splashing of the soda water 56 from the exterior surface 42. In the area of the opening 44, soda water 56 joins with the syrup 52.

This bottom fill method for the accumulator chamber 40 substantially reduces turbulence. This is similar to the effect one would see if a garden hose, with high jet nozzle velocity under high pressure, was inserted into a bucket. As the bucket fills and covers the nozzle, the turbulence substantially decreases.

The nozzle 12 of this invention is constructed so that from the time that the flow of the syrup 52 is initiated and the flow of the soda water 56 is initiated, which is simultaneous, the initial amount of both the soda 56 and the syrup 52 will meet and then be dispensed within the container 54. This is important to achieve even mixing (dispersing) of the soda water 56 and the syrup 52 and to try to minimize stratification. Also, the flow velocity of the soda water 56 is substantially equal to the flow velocity of the syrup 52 at the time such are joined.

As the soda water 56 rises within the chamber 40, and flows through holes 38, the volume of the holes 38 is substantially greater than the volume of the supply tube 16. This means that the overall flow velocity is significantly decreased. This is so as to minimize turbulence and thereby decrease the exit of carbon dioxide from the soda water 56. The greater the carbon dioxide that remains within the soda water 56, the less foam that is created within the mixed beverage 58 within the container 54. The flow of the soda water 56 becomes in essence tubular as it leaves the bottom of the accumulator wall 36 with the syrup 52 being contained within the hollow tubular pattern of the soda water 56. When the soda water 56 and the syrup 52 fall within the container 54, a substantially even mixing occurs.

It is to be noticed that the bottom edge of the supply tube 16 is located a spaced distance from the diffuser housing 48 so that the soda water 56 can be deposited against the diffusing cone 66 and then dispersed evenly across the accumulator chamber 40.

For purposes of cleaning, the supply tubes 14 and 16 can be readily disengaged from the disc 18. Also, the diffuser housing 48 can be disengaged from the supply tube 14. The accumulator wall 36, as well as the confining sleeve 28, may be readily separated and also separated from the disc 18 to achieve cleaning.

What is claimed is:

1. A liquid mixing and dispensing nozzle comprising:

an accumulator chamber defined by an accumulator wall, said accumulator wall having an exterior surface, said accumulator chamber having a bottom and a top with said top being at a greater height than said bottom, said accumulator chamber having a longitudinal center axis, said axis being substantially aligned with the force of gravity;

a first liquid supply tube for discharging a first liquid, said first liquid supply tube discharging said first liquid within said accumulator chamber directly adjacent said bottom;

exit port means found within said accumulator wall directly adjacent said top, said first liquid to be conducted through said exit port means and flow by capillary action along said exterior surface of said accumulator wall to said bottom and then fall free of said accumulator wall; and a second liquid supply tube for discharging a second liquid, said second liquid supply tube discharging said second liquid at said bottom to thereby mix with said first liquid that has fallen free of said accumulator wall.

2. The liquid mixing and dispensing nozzle as defined in claim 1 wherein:

said accumulator chamber being substantially cylindrical, the portion of said accumulator wall located at said bottom being of a lesser diameter than the portion of said accumulator wall at said top.

3. The liquid mixing and dispensing nozzle as defined in claim 1 wherein:

said exit port means comprising a plurality of spaced apart holes located in a circular arrangement.

4. The liquid mixing and dispensing nozzle as defined in claim 3 wherein:

said holes being evenly spaced apart.

5. The liquid mixing and dispensing nozzle as defined in claim 1 wherein:

said second liquid supply tube being located within said accumulator chamber.

6. The liquid mixing and dispensing nozzle as defined in claim 1 wherein:

said accumulator wall including a leakage port, said leakage port to function to empty said accumulator chamber when said first liquid is no longer being discharged within said accumulator chamber.

7. The liquid mixing and dispensing nozzle as defined in claim 1 wherein:

a diffuser housing, said diffuser housing including a liquid conducting passage, said second liquid supply tube being connected to said diffuser housing, said second liquid to be conducted through said liquid conducting passage, said liquid conducting passage for discharging said second liquid exteriorly of said accumulator wall.

8. The liquid mixing and dispensing nozzle as defined in claim 7 wherein:

said diffuser housing including a diffusing cone, said first liquid supply tube being located directly adjacent to but spaced from said diffusing cone, said first liquid to be discharged against said diffusing cone and then into said accumulator chamber.

9. The liquid mixing and dispensing nozzle as defined in claim 7 wherein:

said diffuser housing including at least one leakage port, said leakage port to permit draining of said first liquid within said accumulator chamber when said first liquid is no longer being discharged into said accumulator chamber.

10. The liquid mixing and dispensing nozzle as defined in claim 1 including:

a confining sleeve annularly disposed about said accumulator wall in a spaced apart manner, said confining sleeve functioning to guidingly direct the flow of said first liquid along said exterior surface of said accumulator wall.

11. The liquid mixing and dispensing nozzle as defined in claim 1 wherein:

said second liquid being substantially more viscous than said first liquid.

12. The liquid mixing and dispensing nozzle as defined in claim 1 wherein:

both said first liquid and said second liquid flowing at substantially the same velocity at the time said first liquid and said second liquid fall free of said accumulator wall.

* * * * *